United States Patent [19]

Kikuchi

[11] Patent Number: 4,941,137

[45] Date of Patent: Jul. 10, 1990

[54] TIMEPIECE WITH MOBILE DECORATIONS

[75] Inventor: Koji Kikuchi, Tokyo, Japan

[73] Assignee: Seikosha Co., Ltd., Japan

[21] Appl. No.: 449,582

[22] Filed: Dec. 11, 1989

[30] Foreign Application Priority Data

Dec. 9, 1988 [JP] Japan ..... 63-311614

[51] Int. Cl.[5] ..... G04B 19/00

[52] U.S. Cl. ..... 368/223; 368/228; 368/232; 368/285

[58] Field of Search ..... 368/76, 80, 223, 228, 368/229, 232–237, 285

[56] References Cited

U.S. PATENT DOCUMENTS 2,536,237 1/1951 Thompson ..... 368/229
2,988,879 6/1961 Tupone ..... 368/229
4,525,077 6/1985 Ketner ..... 368/285
4,660,992 4/1987 Paul et al. ..... 368/228

*Primary Examiner*—Vit W. Miska
*Attorney, Agent, or Firm*—Bruce L. Adams

[57] ABSTRACT

A timepiece with mobile decorations includes a casing incorporating a timepiece movement; a drive motor encased in the casing and functioning at arbitrarily set hours; a dial disposed in front of the casing and bilaterally openable and closable about a fixed shaft; a dial opening/closing mechansim, encased in the casing and operable by the drive motor, for opening and closing the dial; and mobile decorations interposed between the dial and a front face of the casing and functioning while the dial is opened so as to be visually recognizable from outside.

2 Claims, 4 Drawing Sheets

TIMEPIECE WITH MOBILE DECORATIONS

BACKGROUND OF THE INVENTION

The present invention relates to a timepiece with mobile decorations.

As known conventional timepieces, there are exemplified a dove clock arranged such that an internally set dove appears from a door which opens at every hour and a so-called "karakuri" or puppet clock having a mechanism in which decorations such as dolls make rotations with a melody of an orgel (music box).

In recent years, full-scale puppet clocks have become popular. These clocks are installed to attract the attention of customers in public facilities such as department stores and supermarkets.

In the majority of the prior art dove and puppet clocks described the above, positions in which the decorations such as doves or puppets emerge are different from the time indicating positions of the timepieces, and the clock dials are typically unmovable.

Accordingly, it is a primary object of the present invention to provide a novel timepiece with mobile decorations, wherein a dial thereof is openable and closable.

SUMMARY OF THE INVENTION

A timepiece with mobile decorations according to the present invention is characterized by: a casing incorporating a timepiece movement; a drive motor encased in the casing and functioning at arbitrarily set hours; a dial disposed in front of the casing and bilaterally openable and closable about a fixed shaft; a dial opening/-closing mechanism, encased in the casing and operable by the drive motor, for opening and closing the dial; and mobile decorations interposed between the dial and a front face of the casing and functioning while the dial is opened so as to be visually recognizable from outside. The dial opening/closing mechanism is composed of lead screws rotationally driven by the drive motor and rotatably supported on the casing, nuts meshing with the lead screws, and an arm rotatably linked to the nuts and the dial as well.

An arrangement of the timepiece of the invention is that the drive motor starts on receiving exact hour signals transmitted from the timepiece movement at preset times, e.g., exact hours; the driving forces are transferred via the dial opening/closing mechanism to the dial which in turn opens about the fixed shaft; simultaneously the mobile decorations disposed behind the dial appear to work; and the dial is closed by reversing the revolutions of the drive motor after a given period has passed.

BRIEF DESCRIPTION OF THE DRAWINGS

The drawings in combination show one embodiment of the present invention.

DETAILED DESCRIPTION OF THE INVENTION

One embodiment of the present invention will hereinafter be described with reference to the accompanying drawings.

Figure 1:
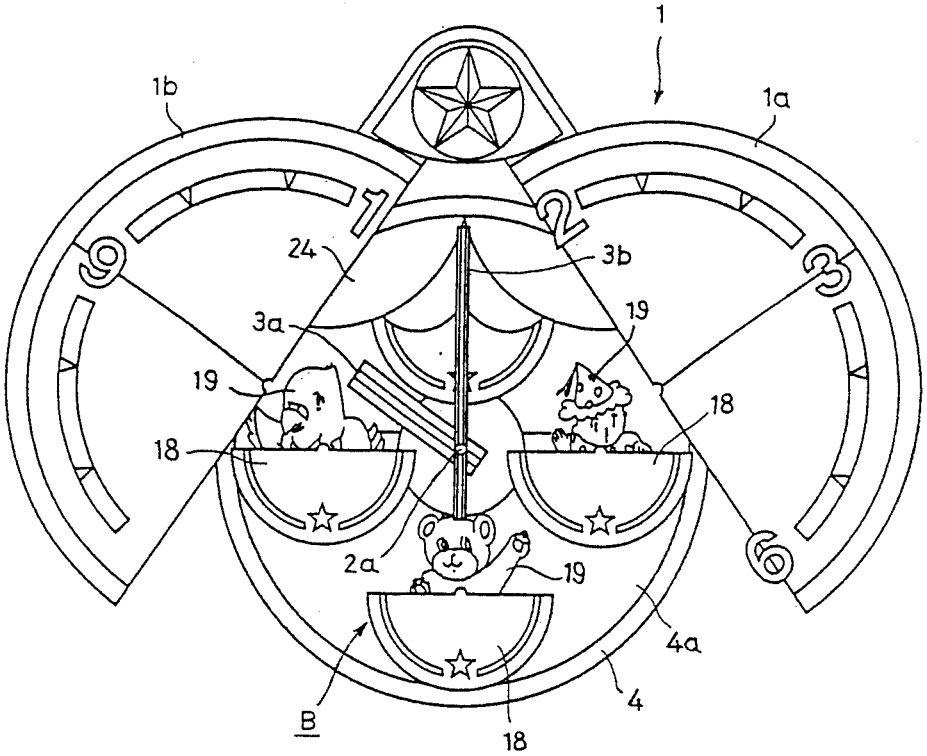
FIG. 1 is a front elevation view illustrating a state where a dial is opened.
Figure 4:
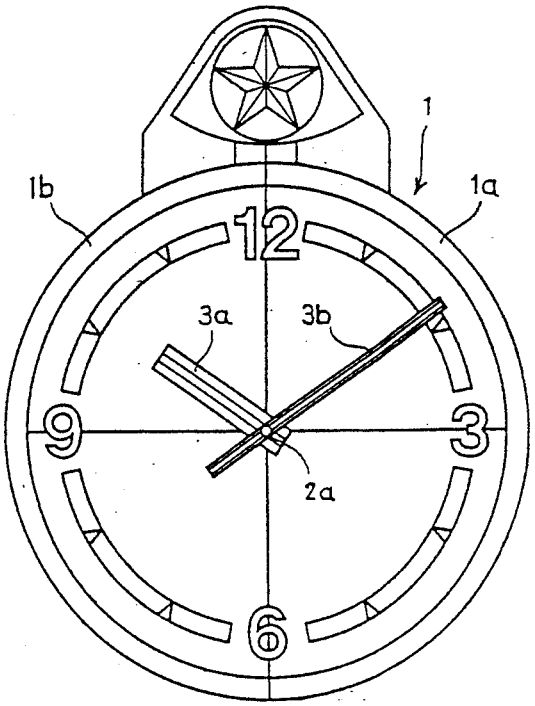
FIG. 4 is a front elevation view showing a state where the dial is closed.

Turning first to FIG. 1, a dial generally designated at 1 consists of a right portion 1*a* and a left portion 1*b* which exhibit a bilateral symmetry with respect to a straight line which connects an hour numeral 12 to an hour numeral 6. Normally, the right portion 1*a* and the left portion 1*b* are, as illustrated in FIG. 4, in a closed state.

Figure 2:
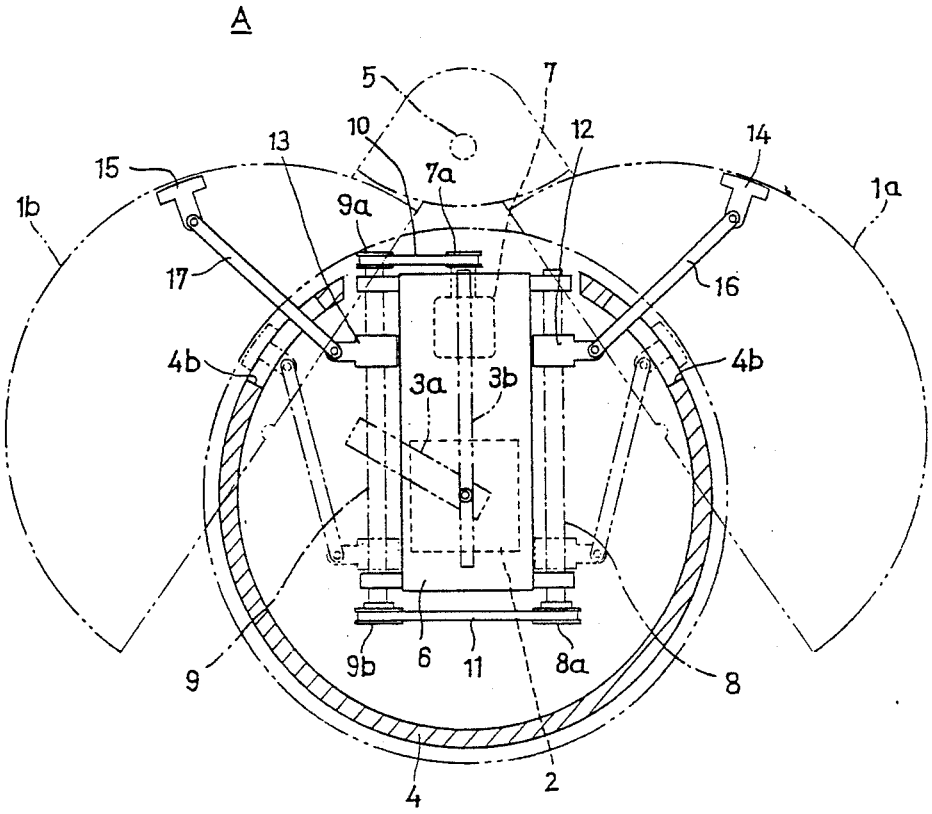
FIG. 2 is a front elevation view in section, depicting a dial opening/closing mechanism.

Provided in front of the dial 1 are an hour hand 3*a* and a minute hand 3*b* rotationally driven by the timepiece movement 2 (FIG. 2).

Disposed in rear of the dial 1 is a cylindrical casing 4 incorporating the timepiece movement 2. A decoration plate 4*a* is provided in front of the casing 4, and mobile decorations B are interposed therebetween. As depicted in FIG. 1, the mobile decorations B are visually recognizable from outside while the dial 1 is opened.

The dial 1 is openable and closable about a fixed shaft 5 (FIG. 2) by means of a dial opening/closing mechanism A. The dial opening/closing mechanism A will now be explained in conjunction with FIG. 2.

The casing 4 accommodates an installing plate 6 mounted with the timepiece movement 2 and a drive motor 7 which works at arbitrarily set times, e.g., exact hours. Two lead screws 8 and 9 each extending in vertical directions are rotatably supported on the bilateral parts of the installing plate 6. A belt 10 is stretched between a belt pulley 9*a* attached to one (the lead screw 9) of them and a belt pulley 7*a* provided on the side of the drive motor 7. Secured to lower parts of the lead screws 8 and 9 are belt pulleys 8*a* and 9*b* each having the same diameter as that of the former pulleys, on which a belt 11 is wound.

Hence, the two lead screws 8 and 9 are concurrently rotationally driven by the drive motor 7.

Nuts 12 and 13 engage with the lead screws 8 and 9 revolutions of which cause an ascent and a descent thereof. On the undersides of the right portion 1*a* and the left portion 1*b* of the dial 1, joints 14 and 15 are fixed in positions corresponding to hour numerals 2 and 10. The joints 14 and 15 are linked via arms 16 and 17 to the nuts 12 and 13. The arms 16 and 17 pass through an opening 4*b* formed in a side wall surface of the casing 4, and both ends thereof are pivotable about the joints 14 and 15 as well as about the nuts 12 and 13, thus constituting a link mechanism.

The description will next be focused on the mobile decorations B.

Figure 3:
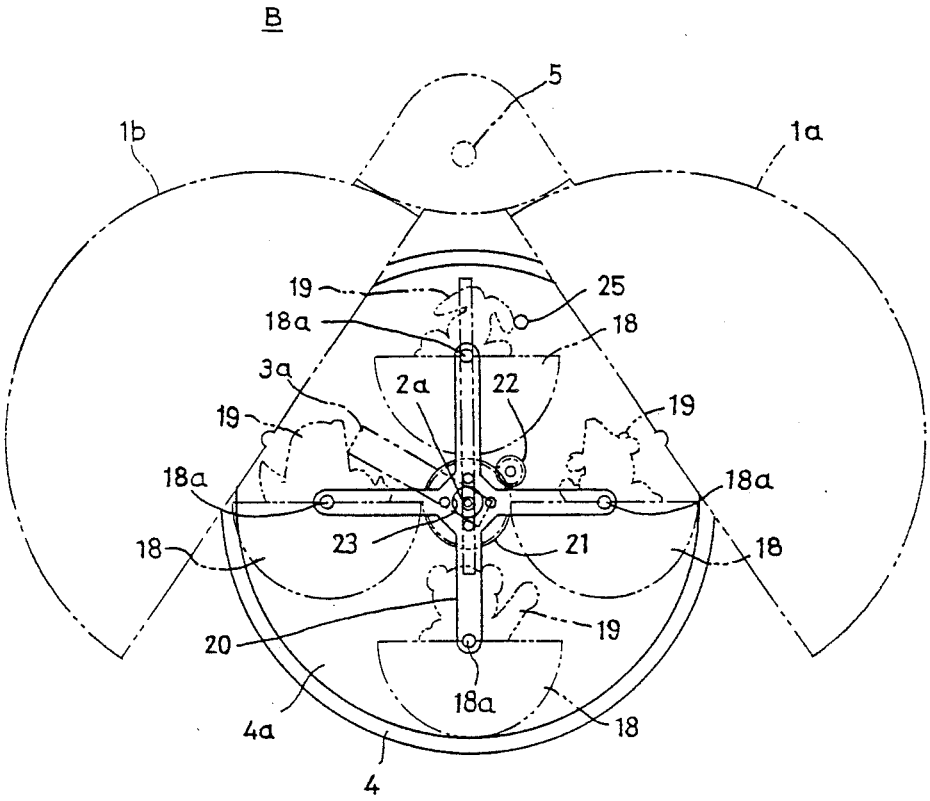
FIG. 3 is a front elevation view showing a mechanism for driving mobile decorations.

The mobile decorations B are, as depicted in FIGS. 1 and 3, composed of four pieces such as baskets 18 placed at equal spacing and decorations 19 rotatably retained by shafts 18*a* while being set in the baskets 18. The four baskets 18 are sustained by a cross arm 20.

The baskets 18 are rotatable about the shafts 18*a* with the aid of the arm 20, and the centroids thereof are positioned lower than the shafts 18*a*. Fixed to the center of the arm 20 by use of a screw is a gear 21 coaxial with a rotational center of the hour hand 3*a* and the minute hand 3*b*, the gear 21 meshing with a pinion 22 fitted to an unillustrated shaft of the drive motor.

A through-hole 23 is perforated in the central parts of the arm 20 and of the gear 21 to provide an escape for a hand spindle 2*a* protruding from the timepiece movement 2.

The decorations 19 rotatably supported with respect to the baskets 18 are classified into two types, one projecting, as illustrated in FIG. 1, from the basket 18 and the other (not illustrated) being so retractable inwardly of the basket 18 as to be visually unrecognizable.

Provided in a position corresponding to the hour numeral 12 in front of the decoration plate 4*a* is a shade 24, imitating a cloud, for concealing one of four decorations 19. A protrusion 25 impinging on the decoration 19 is disposed at the back of the shade 24. The decorations 19 therefore enter the shade 24 and impinge on the protrusion 25. Subsequently, each of the decorations 19 rotates through 180 degrees about the shaft 18*a*, and another decoration (not shown) hidden inside the basket 18 appears from the shade 24.

Next, the operation of the present invention will hereinafter be described.

When reaching the preset time, e.g., an exact hour, the drive motor 7 operates to rotate the lead screws 8 and 9. Concurrently with the rotations of these screws, the nuts 12 and 13 are raised from positions indicated by chain lines of FIG. 2 and cause the right and left portions 1*a* and 1*b* of the dial 1 to turn about the fixed shaft 5 with the help of the arms 16 and 17, thus opening the dial 1. When the nuts 12 and 13 go up to positions drawn with solid lines of FIG. 2, the drive motor 7 ceases to work, and the dial 1 is fully opened (FIG. 1).

The pinion 22 is rotated by an unillustrated drive motor, whereby the gear 21 rotates clockwise. This in turn causes rotations of the baskets 18. The centroids of the baskets 18 are lower than the shafts 18*a*, and hence the baskets are, as in the case of spectator vehicles, kept invariably in constant positions. When the basket enters the shade 24, the decoration 19 impinges on the protrusion 25 and thereby rotates through 180 degrees about the shaft 18*a*. As a result, another decoration (not shown) emerges up from the basket 18 and exits the shade 24.

In this manner, the baskets 18 rotate about the hand spindle 2*a*, and, after a predetermined period has passed, the mobile decorations B cease to function, and the drive motor 7 rotates reversely. Then, the dial opening/closing mechanism A effects the operations reverse to those performed when opening the dial 1, with the result that the dial 1 is closed and reverts to a state depicted in FIG. 4.

Note that the fixed shaft 5 is disposed upwardly of the hour numeral 12, but the arrangement is not limited to this. The fixed shaft 5 may, as a matter of course, be positioned downwardly of the hour numeral 6.

As discussed above, the present invention provides a timepiece with mobile decorations, wherein the dial is opened at the preset hours to show attractive motions, and demands for unexpectedness and uniqueness can be met.

I claim:

1. A timepiece with mobile decorations, comprising:
a casing incorporating a timepiece movement;
a drive motor encased in said casing and functioning at arbitrarily set hours;
a dial disposed in front of said casing and bilaterally openable and closable about a fixed shaft;
a dial opening/closing mechanism encased in said casing and driven by said drive motor for opening and closing said dial; and
mobile decorations interposed between said dial and a front face of said casing and functioning while said dial is opened so as to be visually recognizable from outside.

2. The timepiece as set forth in claim 1, wherein said dial opening/closing mechanism comprises lead screws rotationally driven by said drive motor and rotatably supported on said casing, nuts meshing with said lead screws, and an arm rotatably linked to said nuts and said dial.

* * * * *